US012275580B2

(12) United States Patent
Vallee et al.

(10) Patent No.: US 12,275,580 B2
(45) Date of Patent: Apr. 15, 2025

(54) FLOATING ROOF SECONDARY SEAL

(71) Applicant: Sandborn Roofs Inc., Nisku (CA)

(72) Inventors: Dave Vallee, Nisku (CA); Elias Lopez, Nisku (CA)

( * ) Notice: Subject to any disclaimer, the term of this patent is extended or adjusted under 35 U.S.C. 154(b) by 172 days.

(21) Appl. No.: 18/082,956

(22) Filed: Dec. 16, 2022

(65) Prior Publication Data

US 2023/0202749 A1 Jun. 29, 2023

Related U.S. Application Data

(60) Provisional application No. 63/293,346, filed on Dec. 23, 2021.

(51) Int. Cl.
*B65D 88/42* (2006.01)

(52) U.S. Cl.
CPC ..... *B65D 88/42* (2013.01)

(58) Field of Classification Search
CPC ..... B65D 88/42; B65D 88/46; B65D 88/50; B65D 88/48; B65D 88/44; B65D 88/34–50
See application file for complete search history.

(56) References Cited

U.S. PATENT DOCUMENTS

| | | | | |
|---|---|---|---|---|
| 2004/0016755 | A1* | 1/2004 | Gilbert | B65D 88/34 220/826 |
| 2008/0155918 | A1* | 7/2008 | Ben Afeef | B65D 88/38 52/302.7 |
| 2009/0321447 | A1* | 12/2009 | Imhof | B65D 88/38 220/222 |
| 2014/0190967 | A1* | 7/2014 | Eggemeyer | B65D 88/40 137/15.01 |
| 2014/0263345 | A1* | 9/2014 | Morgan | B65D 88/34 493/100 |
| 2015/0001218 | A1* | 1/2015 | Ellis | B65D 88/40 220/220 |
| 2016/0031637 | A1* | 2/2016 | Bretherton | B65D 88/46 220/222 |

* cited by examiner

*Primary Examiner* — Kareen K Thomas
(74) *Attorney, Agent, or Firm* — Bennett Jones LLP

(57) ABSTRACT

A secondary seal system for a storage tank having a floating roof includes a seal compression plate attached to and extending upwards at an oblique angle from the floating roof, extending around the circumference of the floating roof; a seal element attached to the compression plate for sealing between the compression plate and an inner surface of the storage tank; a plurality of anti-rollover plates attached to and extending upwards from the seal compression plate; and a plurality of anti-rollover braces attached to a major surface of the seal compression plate.

5 Claims, 4 Drawing Sheets

FLOATING ROOF SECONDARY SEAL

FIELD OF THE INVENTION

The present invention relates to a secondary seal system for a floating roof.

BACKGROUND OF THE INVENTION

Field erected storage tanks are commonly used to store large quantities of petrochemicals including both refined and unrefined products. The tank has a cylindrical steel shell and a roof that floats on the surface of the stored liquid, which reduces emissions and evaporative product loss. The roof rises and falls with the liquid level in the tank. There is a rim seal system between the tank shell and floating roof to reduce rim evaporation.

A secondary seal may be provided above a primary rim seal. However, in some cases, the secondary seal can fail due to seal rollover.

There is a need in the art for a secondary seal design which may mitigate seal rollover failures.

SUMMARY OF THE INVENTION

In summary, the invention comprises a secondary seal system for a storage tank having a floating roof, the system comprising:

(a) a seal compression plate attached to and extending upwards at an oblique angle from the floating roof, extending around the circumference of the floating roof;

(b) a seal element attached to the compression plate for sealing between the compression plate and an inner surface of the storage tank;

(c) a plurality of anti-rollover plates attached to and extending upwards from the seal compression plate; and (d) a plurality of anti-rollover braces attached to a major surface of the seal compression plate, for reinforcing the seal compression plate.

In another aspect, the invention may comprise a method of preventing secondary seal roll-over in a storage tank having a floating roof, comprising the step of installing a secondary seal system having a braced seal compression plate attached to and extending upwards at an oblique angle from the floating roof, extending around the circumference of the floating roof, a seal attached to the compression plate for sealing between the compression plate and an inner surface of the storage tank, and a plurality of anti-rollover plates attached to and extending upwards from the seal compression plate for detaching the seal from the inner surface when the anti-rollover plate tips over and makes contact with the inner surface of the storage tank.

BRIEF DESCRIPTION OF THE DRAWINGS

In the drawings, like elements may be assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

DETAILED DESCRIPTION OF EMBODIMENTS OF THE INVENTION

The invention relates to a secondary seal system for a floating roof tank. The secondary seal is installed with a primary seal (1) which seals the floating roof (2) to the inside surface (3) of the storage tank shell. As is well known in the art, the primary seal (1) extends around the entire circumference of the floating roof (2). The storage tank is typically cylindrical with a substantially circular horizontal cross-section. The floating roof is thus a substantially circular member that moves upwards and downwards within the storage tank, and may comprise a steel pontoon floating roof, as is well known in the art. The configuration of the primary seal and the floating roof are not essential elements of the present invention.

Figure 1:
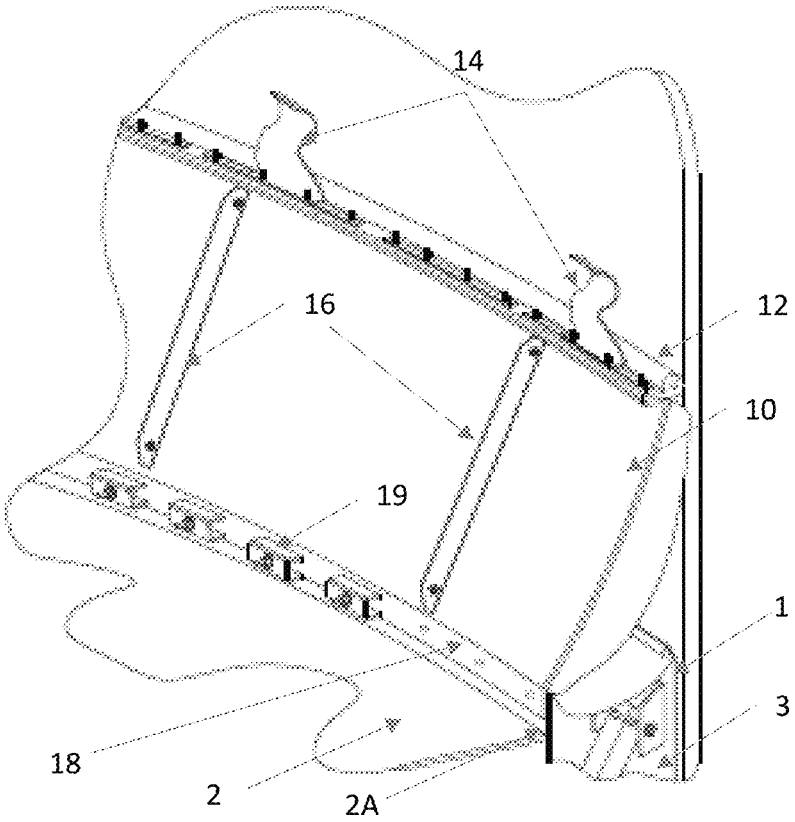
FIG. 1 shows a perspective view of an embodiment of a secondary seal system.

FIG. 1 shows an exemplary embodiment of the secondary seal system which comprises:

(e) a seal compression plate (10) attached to and extending upwards at an oblique angle from the floating roof, extending around the circumference of the floating roof;

(f) a seal element (12) attached to the compression plate for sealing between the compression plate and an inner surface of the storage tank;

(g) a plurality of anti-rollover plates (14) attached to and extending upwards from the seal compression plate (10);

(h) a plurality of anti-rollover braces (16) attached to a major surface of the seal compression plate (10), for reinforcing the seal compression plate (10).

These components may comprise any suitable structurally rigid material, such as steel in a suitable thickness, for example 18 gauge.

The seal compression plate (10) attaches to the floating roof with a lower attachment flange (18) for bolting to the roof rim (2A) and extends upwards, with a seal attachment flange (20) at an upper edge. The seal compression plate is angled obliquely towards the inner surface of the tank, providing a compressive force urging the seal element (12) in contact with the inner surface. As will be apparent to one skilled in the art, the amount of sealing force will depend on the resiliency of the plate (10) when installed, and will increase as the plate (10) moves closer to the inner tank surface.

In some embodiments, the seal compression plate comprises a plurality of plates (10) abutting each other. The horizontal length of each compression plate may be determined by the rim bolt (19) spacing, which is preferably from about 6" to about 10" center to center. Each compression plate should preferably have at least four rim bolt connections, therefore they can range from 23"-42" long. In some embodiments, the compression plates are installed with each plate overlapping an adjacent one, with the overlap ranging from about 1" to about 3". The overlapping plates are bolted together, for example by a ⅜" bolt at the rim and ¼" bolt at the top.

In some embodiments, a vapor barrier membrane (11) may be installed on the underside of the compression plate (10).

Figure 3:
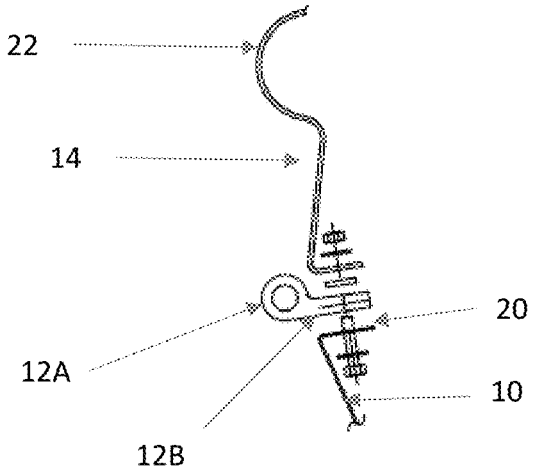
FIG. 3 shows a side cross-sectional detail of a seal and anti-rollover plate installation.

The seal element may comprise a bubble tip seal (12) which comprises a sealing surface (12A) and an attachment flange (12B) which is attached to the seal attachment flange (20), such as with a plurality of bolts, as may be seen in FIG. 3. The seal element may comprise any suitable sealing material, such as a rubber or a polymer elastomer, as is well known in the art.

Figure 4:
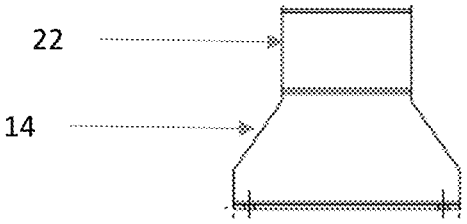
FIG. 4 shows a front view of an anti-rollover plate.

The anti-rollover plates (14) extend up above the seal element (12) and are attached to the seal attachment flange (20) at spaced intervals along the upper edge of the seal compression plate. In some embodiments, an upper portion of the anti-rollover plate has a convex curve (22), as shown in FIGS. 1 and 4. In some embodiments, the base portion of the anti-rollover plate is wider than the upper portion.

Figure 2A:
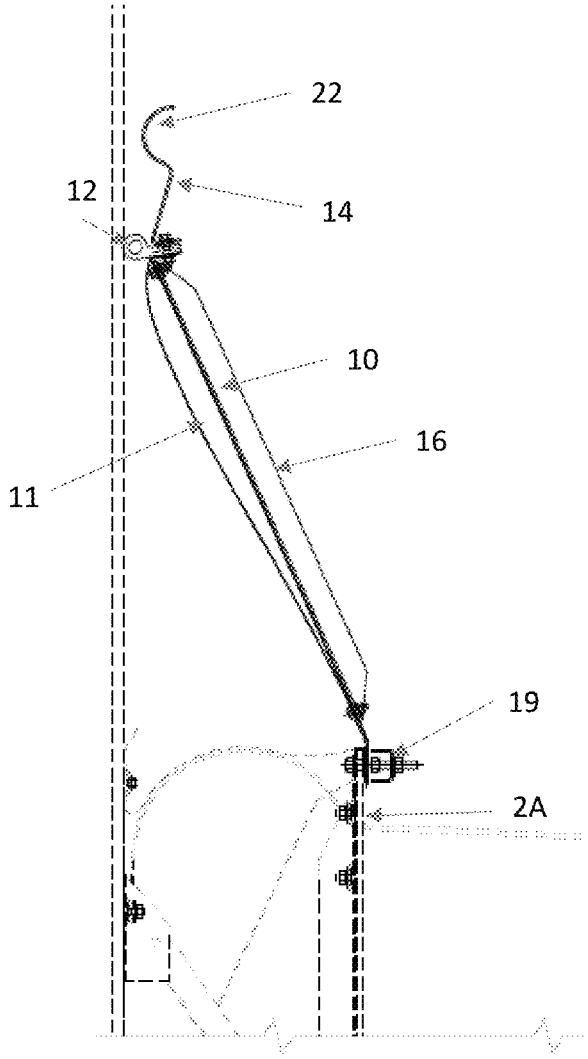
FIG. 2A shows a side cross-sectional view of the embodiment of FIG. 1.
Figure 2B:
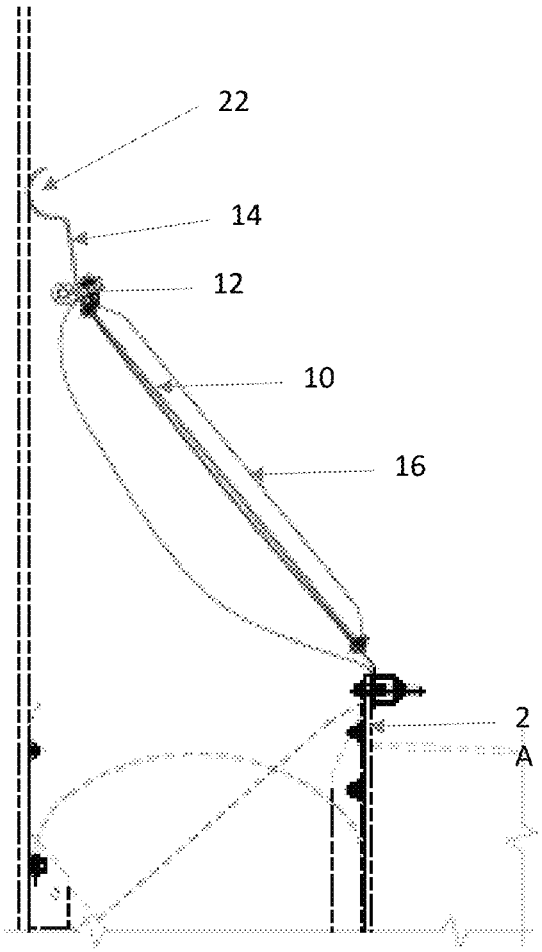
FIG. 2B shows the same view where the secondary seal has detached from the tank shell.

If the seal (12) adheres to the tank shell while the roof (2) moves upwards, it is apparent that the secondary seal mechanism could buckle and fail. In such a scenario, as the roof (2) and the compression plate (10) moves upwards, the lower part of the compression plate (10) is pushed away from the tank wall, and the plate becomes more horizontal, tipping the anti-rollover plate (14) towards the tank shell, as shown in FIG. 2B. As it makes contact with the tank shell, the anti-rollover plate (14) will cause the seal (12) to detach from the tank shell. The angle at which the anti-rollover plate is mounted relative to the seal compression plate determines, in part, when the anti-rollover plate makes contact with the tank shell. Accordingly, the resting angle of the anti-rollover plate and shape of the upper curve (22) may be varied for specific installations and design parameters. Preferably, the anti-rollover plate (14) will make contact with the tank shell at the maximum allowable design parameter.

Figure 6:
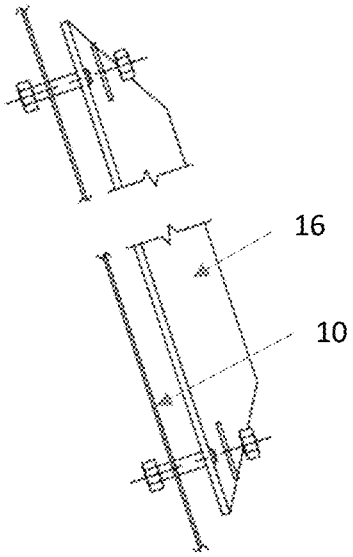
FIG. 6 shows a side plan view of an anti-rollover brace.

The anti-rollover braces (16) are elongated structural ribs oriented substantially vertically and attached to a major surface of the seal compression plate, and which function to brace the seal compression plate and prevent it from buckling or deforming beyond a certain desired amount. In some embodiments, the braces comprise an angled metal piece having an attachment flange (24) which lies flat against the seal compression plate and a bracing flange (26) which extends inwardly from the seal compression plate (10), preferably at a right angle to the seal compression plate. In a preferred embodiment, the brace (16) is bolted to the seal compression plate with two bolts, one each at an upper end and a lower end, as shown in FIG. 6, spaced sufficiently apart to permit some limited deflection of the seal compression plate. Because it is desirable to permit the plate (10) some limited flexibility during normal operation, it is not desired to rigidly bolt the brace (16) to the plate (10) with many bolts.

Figure 5:
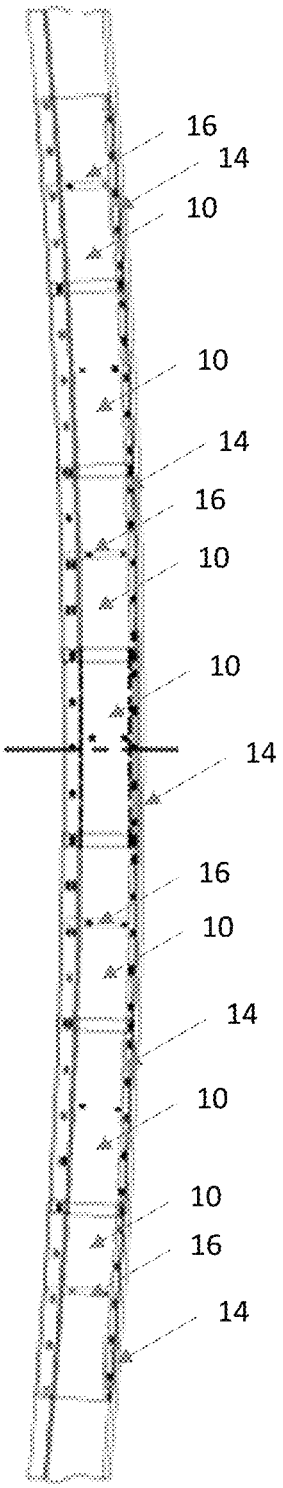
FIG. 5 shows a top plan view of the embodiment of FIG. 1.

In preferred embodiments, as shown in FIG. 5, braces (16) may be installed on every other plate (10), and anti-rollover plates (14) may be installed with desired spacing, such as with spacing slightly reduced from the spacing between braces (16). As will be apparent to those skilled in the art, the number and spacing of the components may be varied to meet desired or required design parameters of the roof system.

Interpretation.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. A secondary seal system for a storage tank having a floating roof, the system comprising:

a seal compression plate attached to and extending upwards at an oblique angle from the floating roof, extending circumferentially around the floating roof;

a seal element attached to the compression plate for sealing between the compression plate and an inner surface of the storage tank;

a plurality of anti-rollover plates attached to and extending upwards from the seal compression plate; and a plurality of anti-rollover braces attached to a major surface of the seal compression plate.

2. The system of claim 1, wherein each anti-rollover plates comprises an upper section with a convex curve away from a tank wall.

3. The system of claim 1 wherein the seal element comprises a bubble tip seal.

4. The system of claim 1 wherein the seal element is disposed between an upper end of the seal compression plate and the anti-rollover plate.

5. The system of claim 1 wherein each anti-rollover brace is bolted to the seal compression plate by two bolts, spaced sufficiently apart to permit some limited deflection of the seal compression plate.

* * * * *